US006010028A

United States Patent [19]

Jordan et al.

[11] Patent Number: 6,010,028

[45] Date of Patent: Jan. 4, 2000

[54] LIGHTWEIGHT RECLOSABLE CAN WITH ATTACHED THREADED POUR SPOUT AND METHODS OF MANUFACTURE

[75] Inventors: Charles L. Jordan, New Kensington; Hans H. Diekhoff, Avonmore, both of Pa.

[73] Assignee: Aluminum Company of America, Pittsburgh, Pa.

[21] Appl. No.: 08/987,654

[22] Filed: Dec. 9, 1997

Related U.S. Application Data

[63] Continuation-in-part of application No. 08/343,743, Nov. 22, 1994, Pat. No. 5,718,352.

[51] Int. Cl.[7] ..... B65D 1/02; B65D 1/12; B65D 25/42

[52] U.S. Cl. ..... 220/669; 220/604; 220/288; 220/902; 215/44

[58] Field of Search ..... 220/288, 319, 220/902, 669; 215/43, 44, 335

[56] References Cited

U.S. PATENT DOCUMENTS

| | | | |
|---|---|---|---|
| 2,339,763 | 1/1944 | Calleson et al. | 220/906 X |
| 2,409,788 | 10/1946 | Osborne . | |
| 2,426,550 | 8/1947 | Coyle | 220/906 X |
| 3,124,273 | 3/1964 | Remington et al. | 215/43 X |
| 3,844,443 | 10/1974 | Cudzik | 215/337 X |
| 4,262,815 | 4/1981 | Klein | 220/273 |
| 4,574,975 | 3/1986 | Taylor et al. | 220/306 |
| 4,793,510 | 12/1988 | Arfert et al. | 220/306 |
| 4,911,323 | 3/1990 | Arfert et al. | 220/257 |
| 5,052,576 | 10/1991 | Budenbender | 220/288 X |
| 5,293,765 | 3/1994 | Nussbaum-Pogacnik | 72/42 |

FOREIGN PATENT DOCUMENTS

| | | | |
|---|---|---|---|
| 633497 | 1/1928 | France . | |
| 2497315 | 7/1982 | France | 220/319 |
| 2337929 | 11/1974 | Germany | 220/319 |

*Primary Examiner*—Sue A. Weaver
*Attorney, Agent, or Firm*—David W. Brownlee; Edward L. Levine

[57] ABSTRACT

Thin wall metal cans are described having threaded necks attached thereto for receiving threaded closure to seal contents in the cans. Techniques for forming such threaded cans are also provided.

4 Claims, 15 Drawing Sheets

LIGHTWEIGHT RECLOSABLE CAN WITH ATTACHED THREADED POUR SPOUT AND METHODS OF MANUFACTURE

CROSS-REFERENCE TO RELATED APPLICATIONS

This application is a Continuation-in-Part of U.S. patent application Ser. No. 08/343,743, filed Nov. 22, 1994, U.S. Pat. No. 5,718,352.

BACKGROUND OF THE INVENTION

1. Field of the Invention

This invention relates to methods for manufacturing of metal cans, and in particular to the manufacture of a reclosable can having a threaded neck portion for receiving a threaded closure to seal contents in the container. The threaded neck portion on a can of this invention is attached to a cylindrical can body and has threads integrally formed therein or on a threaded sleeve on the neck portion. The threaded neck portion is secured on the top of the can by double seaming, adhesive or other permanent attachment means. The threaded portion is adapted to receive a plastic or metal closure.

2. Description of the Prior Art

It is known to form drawn, or drawn and ironed, cans from aluminum and steel for use in packaging of beer, soft drinks, oil, and other liquids and also for use as aerosol containers for a variety of products. Most metal cans for beer and beverages are adapted to be closed with relatively flat lids or ends which are secured on the cans by double seaming or the like. The lids may have tear strips formed in them and have pull tabs attached to the tear strips to facilitate forming pouring openings in the lids. It is also known to provide cans with cone top ends on them as disclosed in U.S. Pat. Nos. 4,262,815; 4,574,975; 4,793,510 and 4,911,323. It is further known to provide an easy opening container with a reduced diameter cylindrical portion on it and angular spaced thread segments on the cylindrical portion as disclosed in U.S. Pat. No. 3,844,443. That patent also discloses a method for forming such a container which includes one or more forming operations such as drawing and ironing operations.

U.S. Pat. No. 5,293,765 discloses a method and apparatus for manufacturing threaded aluminum containers by deep drawing, deep drawing and additional stretching, or extrusion, and rolling threads in a necked-in portion on the end of the container. The threads are formed by positioning first and second thread rolling tools adjacent the inside and outside surfaces of the container and rotatably moving the tools against the surfaces. The patent states that the container wall thickness must be maximally 20% of the pitch of the thread used for the container.

Threaded aluminum containers have typically been made from relatively thick metal, i.e., at least 0.020 inch thick. The aluminum has typically been relatively soft in order to permit the forming of the threads in such neck.

An improved method is desired for forming a can having a threaded neck portion from thin gauge hard temper metal which is preferably an aluminum alloy. Additionally, an improved metal can is desired which has a threaded neck on it for securement of a closure on the can. A method is desired for forming threaded cans from hard temper aluminum alloy sheet material having a thickness of about 0.007–0.015 inch. A threaded aluminum can is desired which is capable of holding positive pressure in the can in the range of 40 to 110 psi when closed with a threaded closure.

SUMMARY OF THE INVENTION

This invention provides methods a reclosable can made of thin gauge hard temper metal, such as hard temper aluminum alloy or steel, and have a permanently attached top portion with threads on it for receiving a threaded closure. A can having an attached top portion made in accordance with this invention has a reduced diameter cylindrical portion on it with threads formed in such cylindrical portion or in a sleeve secured around the cylindrical portion. The top portion may be cone-shaped and may be double seamed, adhesively bonded or otherwise secured on a cylindrical can body.

It is an objective of this invention to provide a method for forming threaded metal containers which are lighter weight than the prior art containers.

It is also an objective of this invention to provide improved metal beverage containers which are adapted to be closed by threaded closures.

BRIEF DESCRIPTION OF THE DRAWINGS

The present inventive method and product of this invention are described in exemplified manner herein relative to drawings wherein.

In several of the Figures, single lines are used instead of double lines, in cross-section since the material is too thin to be reasonably shown as double lines.

DESCRIPTION OF THE PREFERRED EMBODIMENTS

As used herein, the words "upwardly","downwardly", "inwardly", "outwardly","horizontal","vertical" and the like are with reference to a can or can top which is disposed in an upright position with its mouth opening upwardly.

Figure 1:
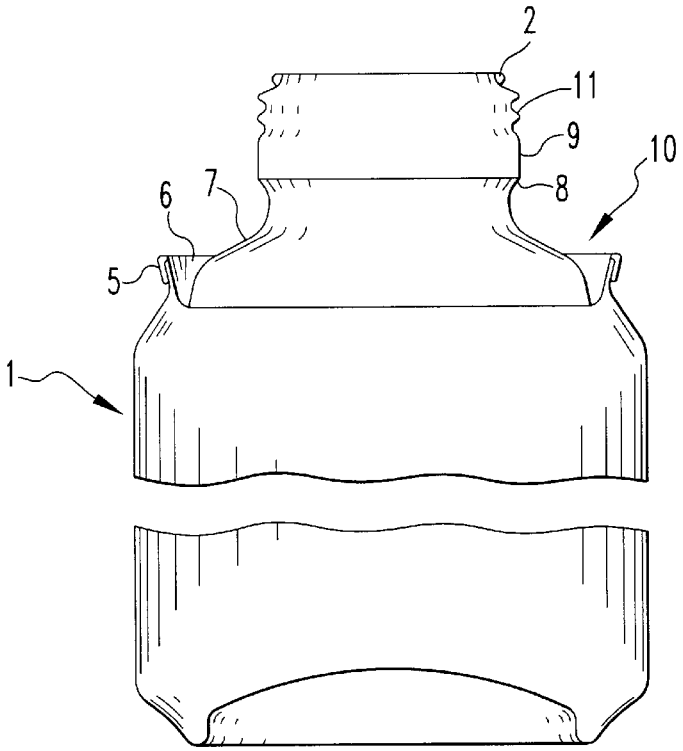
FIGS. 1–2 are vertical cross sectional views through two cans having cone tops on them which have been formed in accordance with this invention.

FIG. 1 shows metal can 1 which includes a can body 4 and a threaded cone top 10 on it which has been produced from a sheet of hard temper, thin gauge metal in accordance with this invention. The metal in the can body 4 is preferably am aluminum alloy in the 3000 series and the metal in the cone top 10 is preferably an aluminum alloy in the 3000 or 5000 series alloys, such as for example 5042 alloy which is in an H-19 or H-39 temper as such alloys and tempers are registered by the Aluminum Association. The aluminum in the can body 4 has metal thicknesses which are typical for drawn and ironed beer and soft drink cans. The aluminum in the cone top 10 may be about 0.007–0.015 inch thick, and is preferably about 0.0135 inch thick for a 3 inch diameter can. The cans may be of a variety of heights and diameters with an example being about 3 inches in diameter, approximately 7⅛ inches high and designed to hold approximately 20 fluid ounces. Other cans of this invention may have diameters in a range of approximately 2 inches to 3.25 inches and heights approximately 3.50 inches to 10 inches and may hold anywhere from 7 liquid ounces to 32 or more liquid ounces. This invention facilitates the use of thin gauge, hard temper metal to manufacture threaded lightweight cans which are unlike the heavy gauge threaded aluminum cans produced by previously known methods and apparatus.

The metal from which the cone top 10 is formed is preferably coated, at least on its inside surface, with a protective coating such as a polymer or an epoxy to prevent corrosion of the metal and possible adverse effects on the flavor of the contents of a container on which the top is secured. The coating can be applied by roll coating, spray (liquid or powder) coating, electrocoating or other similar techniques. The forming process of this invention is designed to minimize possible damage to the sheet metal and its coating during the forming operations. However, in some cases, a repair coating may be applied on the inside of the top 10 after it has been formed.

The cone top 10 (of FIG. 1) includes an outer peripheral flange 5 which is seamed onto the peripheral edge of the open end of a can body 4. The top further includes an annular groove 6 which accommodates the seaming tools and facilitates the seaming operation. The annular groove 6 also provides resistance to outward buckling of the metal in the top 10 when exposed to internal pressures in a range of about 40 to 110 psi, with 110 psi being about the maximum pressure in containers for beer and carbonated soft drinks. The cone top 10 further includes a frustoconical portion 7 which is also beneficial to providing pressure holding strength, an outwardly-projecting shoulder 8 below an annular bead 9, threads 11, and a curled bead 2 around the mouth of the cone top.

Figure 2:
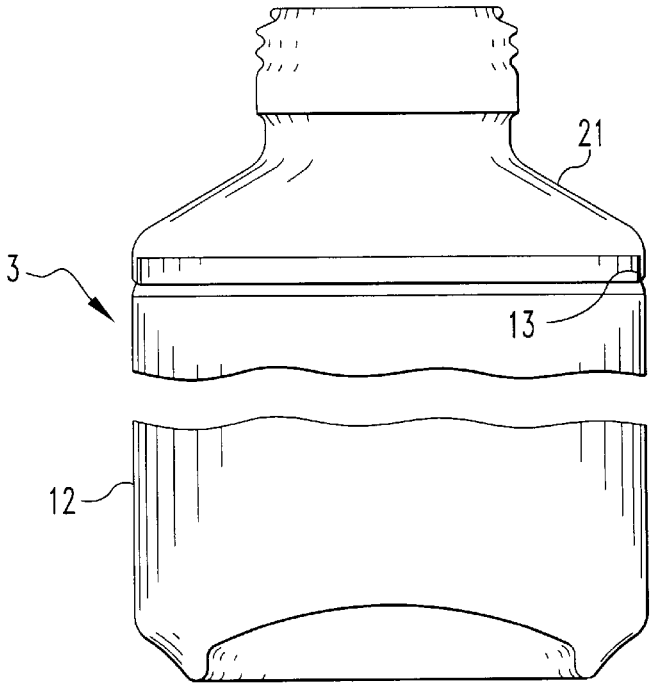

FIG. 2 shows an alternative embodiment of a can 3 having a threaded cone top 21 which has been made in accordance with this invention and adhesively bonded on the top of a drawn and ironed aluminum can body 12. The can body 12 has a reduced diameter portion 13 on its top end. The cone top 21 fits over such reduced diameter portion 13 and is adhesively bonded thereto. The cone top 21 is otherwise essentially the same as the cone top 10 of FIG. 1.

Figure 3:
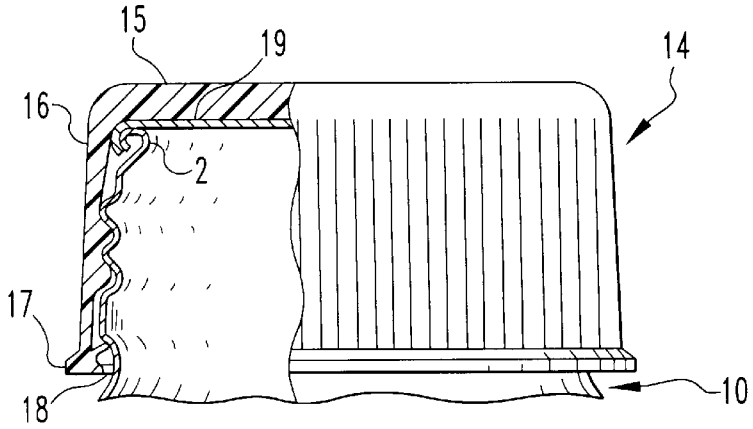
FIGS. 3 and 4 are enlarged vertical cross-sectional views through the threaded portion of can tops of the present invention with threaded closures on them.
Figure 4:
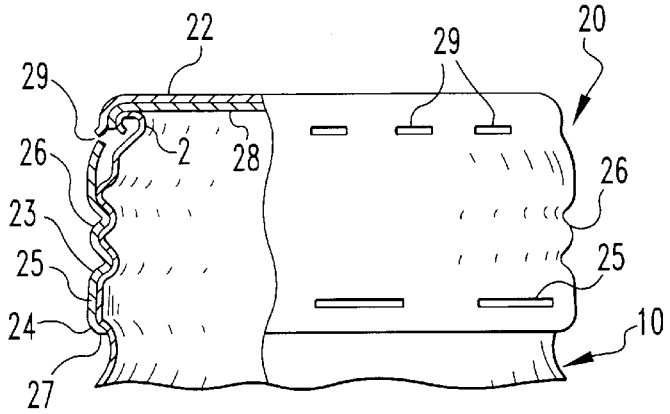
Figure 5:
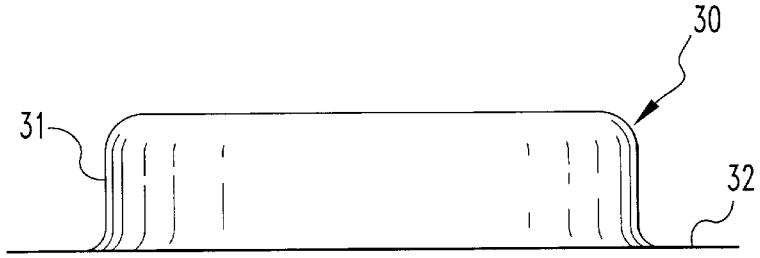
FIGS. 5–10 show a progression for forming sheet metal to form a cone top for a can in accordance with the present invention preparatory to forming threads in the top.

Threaded cans of this invention are adapted to receive and be closed and/or sealed with a metal or plastic closure as shown in FIGS. 3 and 4. The closures are preferably threaded before being applied on the cans, but metal closures can also be roll formed on a threaded can of this invention provided any top load that is applied to the container during such roll forming does not exceed the column strength of the container or the threaded portion of the can is supported against such top load as through a transfer ring on the can neck. FIG. 3 shows a plastic closure 14 of the type described and illustrated in U.S. Pat. No. 4,938,370, assigned to H-C Industries, Inc., which is secured on the cone top 10 of FIG. 1. The closure 14 has a top wall 15, an internally threaded skirt 16 and a tamper evident band 17 with a plurality of inwardly projecting flexible tabs 18 on the band which are adapted to retain the band on the can when the remainder of the closure 14 is unscrewed from the can. The closure 14 has a frangible connection such as slots and connecting bridges (not shown) between its skirt and the tamper evident band. This frangible connection breaks when the closure is unscrewed from the threads on the can to leave the pilfer band on the container. Alternatively, the pilfer band can also have one or more vertical lines of weakening in it which break when the closure is removed from a container so the band remains attached to the closure instead of remaining on the container as disclosed, for example, in U.S. Pat. No. 4,720,018, assigned to H-C Industries, Inc. The disclosures contained in U.S. Pat. Nos. 4,720,018 and 4,938,370 are incorporated by reference into this application.

The closure 14 preferably includes a sealing liner 19 which seals the closure on the can to retain the contents and any carbonation in the container. The liner may seal against both the top surface and outer side surface of the container bead 2 to provide seal fidelity. The curled bead on a threaded can of this invention is especially adapted to be formed with close tolerances and therefore provide high seal fidelity when the can is closed with a threaded closure. The curled bead provides a smooth surface with essentially no wrinkles or irregularities in it which might interfere with obtaining an effective seal between the closure and the can.

FIG. 4 shows a metal closure 20 secured on a cone top 10 (FIG. 1) of this invention. The closure is preferably made of aluminum alloy in the 3000 or 5000 series and may be approximately 0.008–0.015 inches thick. U.S. Pat. Nos. 2,994,449; 3,106,808; 3,127,719; 3,460,703; 3,464,576; 3,750,821 and 4,519,516 disclose some metal closures of the type which could be used to close threaded can of this invention. The closure 20 shown in FIG. 4 includes a top wall 22, a skirt 23 and a pilfer evident band 24 at the bottom of the skirt and connected thereto by a line 25 of scores and bridges that are breakable when the closure is unscrewed from the container. The closure 20 has threads 26 formed in its skirt 23 and is adapted to be rotated or screwed onto the can. The bottom edge 27 of the pilfer band 24 is preferably adapted to be rolled or formed under the shoulder on the bead on the can to prevent the pitler band from being removed from the container except by rupture of the score line 25 and/or rupture of a vertical weakening line, not shown, in the pilfer band. Depending on the closure design, the pilfer band can either remain on the container or be removed with the closure when the closure is unscrewed from the can.

The closure 20 includes a sealing liner 28 which is adapted to seal against the top and outer surfaces of the bead 2 on the can. The liner 20 is either a disc liner which is inserted in the closure or a molded-in liner as is known in the art. The closure 20 preferably has a plurality of vent slots 29 around the top outer corner to vent gases from the can during removal of the closure from the can as is disclosed in U.S. Pat. No. 4,007,851.

For some applications, aluminum closures may be preferred for sealing cans of this invention in order to facilitate recycling of the cans with the closures on them. The plastic liner and coatings on the aluminum in such closures are a minor part of the package and do not interfere with recycling the entire package. In fact, such small quantities of plastic are combusted during recycling and provide heat energy useful to recycling. Aluminum closures may also be preferred for cans which are to be retorted, pasteurized or heated during the filling process.

FIGS. 5 through 13 show the progression of shapes that a sheet of thin gauge, hard temper metal goes through in the production of a cone top in accordance with this invention. The tools for such progression are not shown since such tools are known in the art. The present invention resides primarily in the sequence of operations for forming the top and the percent reductions taken in such forming, and not in the specific tools. This invention is directed to forming the desired shapes while minimizing damage to coating integrity and taking optimal advantage of the aluminum's formability.

The first step in the method of this invention is to blank or cut a round disc 30 from metal sheet and to draw a low cylindrical boss 31 in the center of the disc. An annular flange 32 circumscribes the boss 31. This blanking and drawing is preferably performed in one single operation but may comprise two operations. It is important to this invention that the first draw reduction in forming the boss 31 not exceed approximately 45%, and is preferably about 30–40% in forming thin gauge, hard temper aluminum alloy. The percent reduction is calculated by the following formula:

$$\text{Percent Reduction} = \frac{\text{Cut Edge Diameter} - \text{Boss Diameter}}{\text{Cut Edge Diameter}}$$

With a 40% reduction, the boss 31 would have a diameter which is approximately 60% of the diameter of the disc. A 30% reduction would produce a boss diameter which is approximately 70% of the disc diameter. Application of this invention to the manufacture of steel cone tops and cans may require different percentage reductions due to the different properties of steel, e.g., strength and formability, as compared to aluminum.

Figure 6:
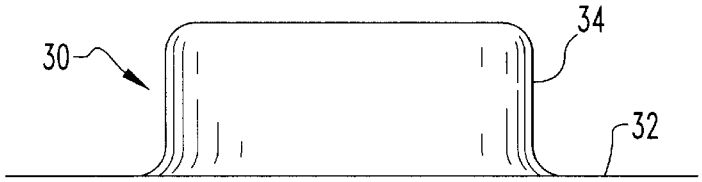
Figure 7:
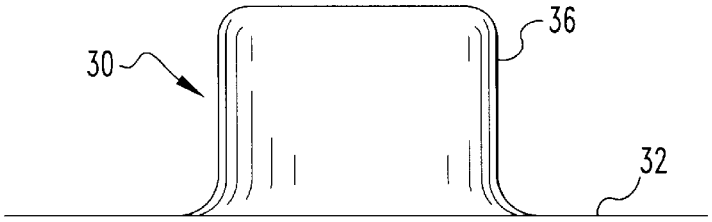
Figure 8:
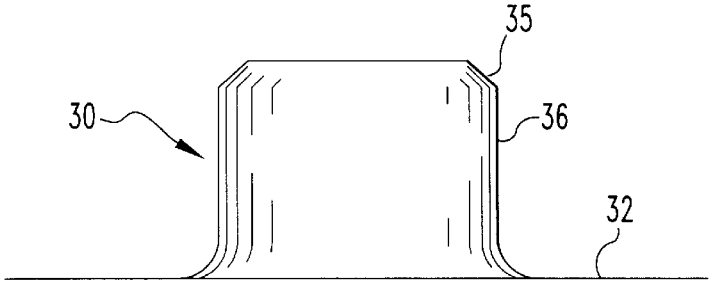

The next steps, as shown in FIGS. 6–8, are to redraw the boss 31 to increase its height and reduce its diameter. In accordance with this invention, it is important to redraw the boss 31 at least two times to form progressively higher bosses 34 and 36 with progressively smaller diameters without tearing or wrinkling the metal. The optimum number of redraws will depend on several factors including the gauge, temper, and formability of the metal, coatings on the metal, the diameter of the cone top and the neck portion thereon, and the diameter of the threaded neck to be formed. This progressive redrawing is critical in forming thin gauge, hard temper metal to produce a reduced diameter neck portion having sufficient length and an appropriate diameter to receive a threaded closure. The percent reduction in the first redraw operation of thin gauge, hard temper aluminum alloy should be no more than about 35% and preferably about 30% depending on metal gauge, temper, strength, formability and coatings. The reduction in the second redraw should be no more than about 30% and preferably about 25%. If a third reduction is desired, it should be no more than about 25% and preferably about 18–20%. The percent reduction is based on the change in the diameter of the bosses 34 and 36 between successive redraws. The outer diameter of flange 32 is preferably not affected by the redraw operations. It is desirable to maximize the reduction taken in each redraw in order to minimize the number of redraw operations. Conversely, the percent reduction must not be so great as to cause tearing or wrinkling of the metal during such redraw.

FIG. 8 shows the disc 30 after the step of reforming to form a frusto conical bead angle portion 35 on the end of the boss 36.

Figure 9:
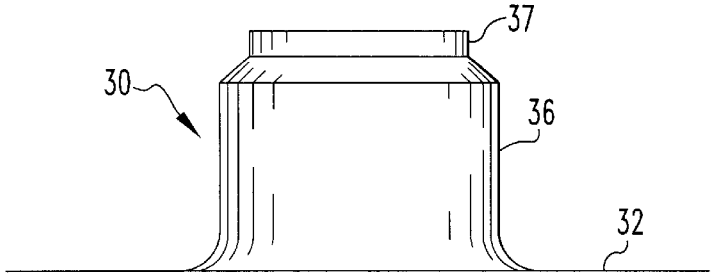

FIG. 9 shows the article 30 after a center portion of the end wall of the boss 36 (FIG. 10) has been removed by a blanking or piercing operation in a manner well known in the art and the cut edge around the opening has been wiped upwardly to extend the length of the boss 36 and leave an upwardly projecting flange 37 around the opening in the boss to be formed into an outwardly curled or folded bead. Alternatively, the cut edge of boss 36 can be wiped down for subsequent forming into an inwardly curled or folded bead. In the embodiment selected for illustration, approximately the center 70–75% of the end wall of the boss 36 has been cut out and the remaining 30–25% has been wiped upwardly to form the flange 37.

Figure 10:
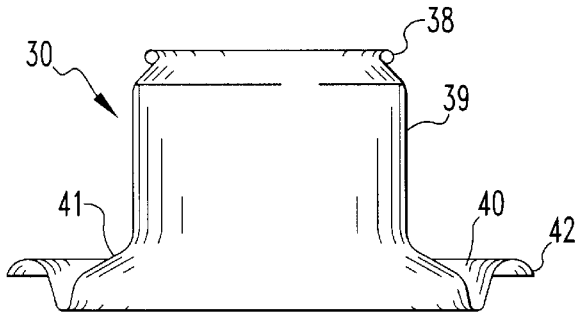

FIG. 10 shows the article 30 after it has been trimmed around its lower peripheral edge and reformed into a pouring spout 39 with frusto-conical portion 41, an annular groove 40 and an outwardly extending curvilinear flange 42 around the lower peripheral edge of the spout portion. The flange 42 and groove 40 are designed to facilitate handling and attachment of the cone top to an open end of a can body in the same manner that a typical flat can end is attached to a can body.

Figure 14:
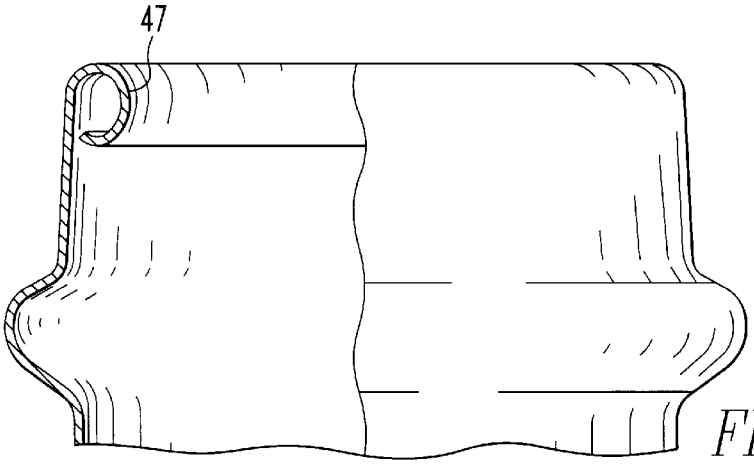

FIG. 10 further shows a curled bead 38 around the top edge of the spout portion on the article. The bead 38 is shown curled outwardly but can also be curled inwardly for some applications as shown in FIG. 14. An outward curl should minimize the possibility that the terminal or cut edge of metal in the bead might be contacted by the contents of a container on which a cone top is secured. The outward curl will also minimize the possibility that beverage in the container might be trapped in the bead. An inwardly-curled bead may offer advantages such as formability, aesthetics or the like.

Figure 11:
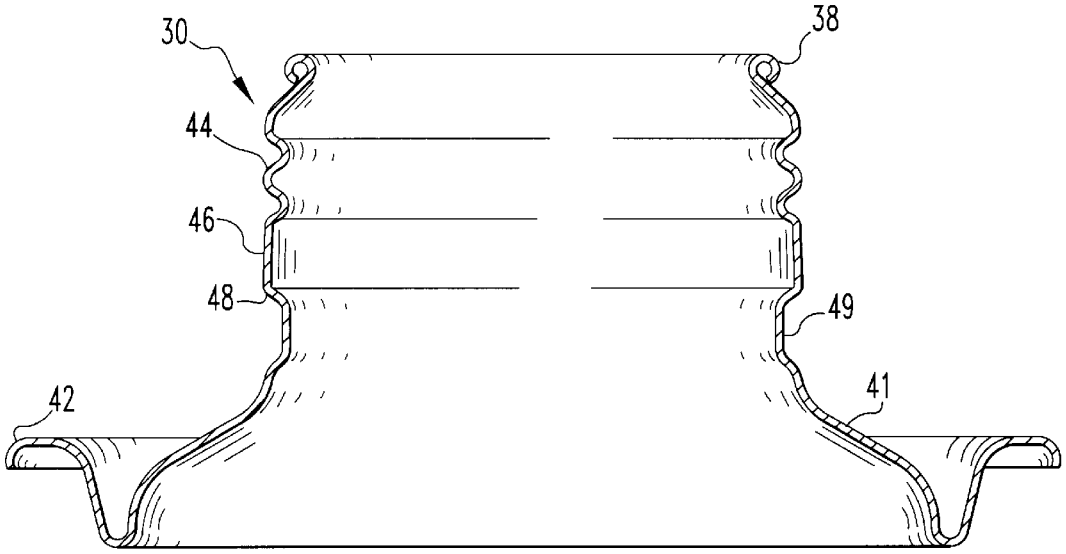
FIG. 11 is an enlarged vertical cross-section through the cone top, of FIG. 10 after threads have been formed in it.

FIG. 11 is an enlarged cross-sectional view of the top portion of the cone top 30 after it has been further reformed to provide threads 44 and on outwardly-projecting annular bead or locking ring 46 below the threads. The bead 46 has a downwardly and outwardly facing shoulder portion 48 under which a pilfer evident band on a closure can be formed.

The neck portion 49 of the spout between the locking ring 46 and the frusto-conical portion 41 has a smaller diameter than the locking ring. In a preferred method of making the cone top the neck portion 49 is formed by rolling this portion radially inwardly after the threads 44 have been formed. The bead 38 is preferably curled to have a relative small diameter of approximately 0.050–0.080 inch to maximize the diameter of the pouring opening and avoid interference with the threads on a closure which is applied on the cone top. The diameter of bead 38 should be in the range of about 3–7 times the thickness of the metal in the neck. Alternative bead or folded edges such as those shown in FIGS. 12, 13 and 14 can also be used with this can. The bead 38 may be formed either before or after the threads 44 are formed in the neck portion. Forming the bead before the threads are formed is preferred for some applications since the bead provides reinforcement to the necked portion to help resist any undesirable distortion of the neck during formation of the threads. Forming the bead before thread forming will help maintain concentricity of the threads and maintain a parallel relationship between the bead 38 and the base of the cone top 30.

The threads 44 may be formed by a variety of techniques such as by thread rollers similar to those shown in U.S. Pat. No. 2,409,788 for rolling threads in a bottle closure. A mandrel having threads on it is first positioned in the neck of the can and the rollers applied against the outer surface of the neck and rolled around the neck to move the metal radially inwardly into the threads in the mandrel. In a preferred method, the threads 44 are formed before the neck portion 49 is formed so the mandrel can be inserted in and removed (by unscrewing it) through the larger opening in the bottom of the cone top. The mandrel can also be collapsible to permit removing it from the threaded neck of the can.

The threads 44 may alternatively be formed by a thread rolling machine and tools which are similar to those available from E. W. Bliss Industries, Inc. of Chicago, Ill. or Lou-Jan Tool & Die, Inc. of Cheshire, Conn. U.S. Pat. No. 5,293,765 to Nussbaum also discloses a thread rolling operation in which a support tool or roller is positioned in the spout and another tool or roller is rotated against the outer surface of the spout to form the metal between the two rollers.

The threads may also be provided on the cone top 30 by positioning a threaded sleeve around the pouring spout 39 (FIG. 10) and securing the sleeve in position in a manner similar to that shown in FIGS. 16 and 17 and described below. The sleeve may be either metal or plastic.

The threaded cone top 30 shown in FIG. 11 is now ready to be seamed or otherwise secured on the open end of a can body to produce cans such as that shown in FIG. 1. This can be done by conventional double seaming. Alternatively, the cone may be shaped like the one shown in FIG. 2 which is bonded to a can body. The can body is preferably a drawn and ironed aluminum can body made of 3000 series aluminum alloy. The can is adapted to be filled through the spout and a threaded plastic or metal closure sealed thereon as shown in FIGS. 3 and 4.

Figure 12:
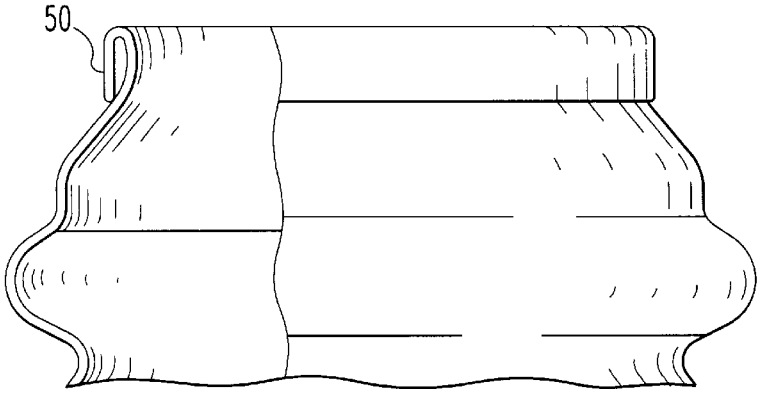
FIGS. 12–14 show some alternative beads for spouts on threaded cans of this invention.
Figure 13:
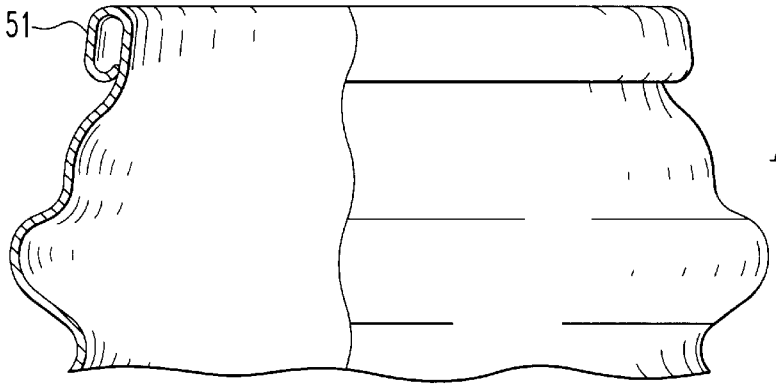

The bead or folded edge on the mouth opening is important for several reasons including its functioning to provide a sealing surface, shielding of the edges of the metal, strengthening for the mouth opening, and maximizing the size of the month opening. Several alternative beads or edge treatments may be provided with this invention to maximize the desired performance requirements including an outwardly folded edge 50 as seen in FIG. 12 (can also be inwardly folded), a flattened bead 51 as seen in FIG. 13, and the inwardly-curled bead 47 of FIG. 14. The folded edge 50 and flattened bead 51 permit a larger diameter mouth opening than does the curled bead 38 of FIG. 11. The curled bead 38 is thicker than the folded edge 50 or flattened bead 51 and must therefore result in a smaller diameter of the inner surface of the bead to avoid interference with the threads of a closure which is secured on the cone top.

Figure 15:
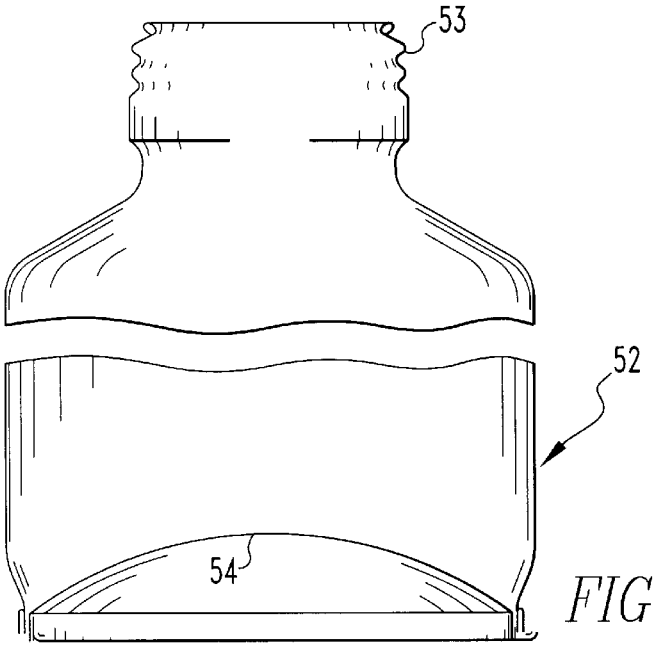
FIG. 15 shows an alternative form of can body of this invention which has a neck portion formed by a draw/redraw progression and with threads formed in the neck portion and a bottom end wall seamed on the can body.
Figure 16:
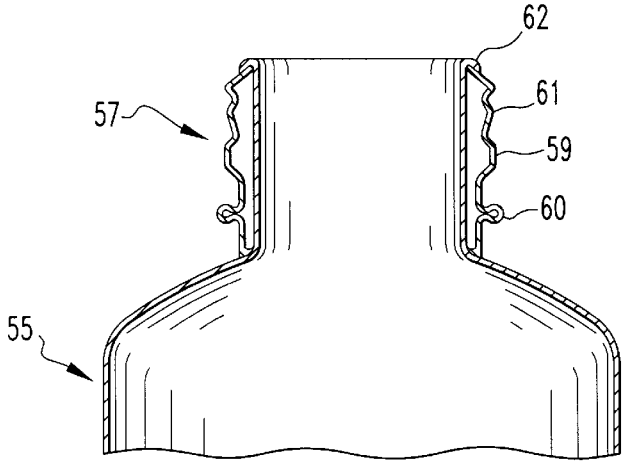
FIGS. 16 and 17 are fragmentary views of alternative embodiments of the top neck portion of the cans of this invention with threaded sleeves secured on the neck portions.
Figure 17:
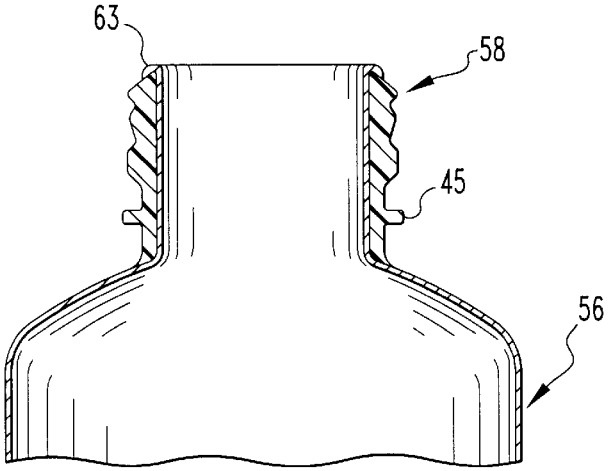

FIGS. 15, 16 and 17 illustrate alternative embodiments of threaded cans produced in accordance with this invention. These cans are formed by a draw, redraw, and sidewall ironing progression as illustrated in FIGS. 18–27. The can 52 of FIG. 15 has an integral threaded spout 53 on its neck portion for receiving a threaded closure (FIGS. 3 and 4) and has an inwardly domed bottom end wall 54 double seamed on she can. The cans 55 and 56 of FIGS. 16 and 17 are similar except that threaded sleeves 57 and 58 are secured on the spouts on those cans. The can 55 in FIG. 16 has a metal sleeve 57 on the neck portion and the can 56 in FIG. 17 has a plastic sleeve 58 on the neck portion. The sleeve 57 includes an annular outwardly-projecting bead 59, an optional annular folded lip 60, and threads 61 for receiving a threaded closure. The folded lip 60 is optional for some cans for applications in which it may be desirable to support the can on the lip during transfer or on a filling line during application of a closure on the can. The threaded sleeves shown in FIGS. 16 and 17 are also adapted for use on cone tops such as these shown in FIGS. 1 and 2 in lieu of integral threads on the cone tops.

The sleeve 57 is secured on the can 55 by an outwardly-projecting curvilinear flange 62 which overlies the sleeve. In the manufacture of the can 55, the sleeve 57 is first telescoped over the cylindrical neck of the container, and the flange 62 is rolled or curled outwardly and downwardly to press against the top of the sleeve to secure the sleeve against the frustoconical neck portion and hold the sleeve in such position. To prevent rotation of the sleeve on the can, small dents, ribs, slots or the like can be provided on the can and/or the sleeve. Upon curling or forming of flange 62, metal in the flange will flow into or around such ribs or slots to lock the sleeve in non-rotatable position on the can. The sleeve can also be adhesively bonded to the can to prevent relative rotation. The flange 57 provides a top surface against which a closure or closure liner (not shown) can be sealed.

FIG. 17 shows a similar can 56 on which a plastic sleeve 58 is eased instead of a metal sleeve. The plastic sleeve 58 is secured on the spout or neck of the can much like the metal sleeve of FIG. 16 with an outwardly curved flange 63 and preferably has splines on an inner surface for engaging metal in the neck of the car, to restrain the sleeve against rotation on the can. The plastic sleeve 58 optionally includes a transfer lip 45 similar to lip 60 on sleeve 57.

FIG. 18–27 show a forming progression for making a can like the one shown in FIG. 15 having an integral spout top on it. The same sequence can be used for making the cans 55 and 56 of FIGS. 16 and 17 except that separate threaded sleeves would be secured on the cans instead of forming integral threads on the cans. The sequence for forming a can with an integral spout top is similar to the sequence for forming a separate cone top except that the progression includes the formation of a container sidewall. Again, the tools are not shown since they are conventional tools known in the art. The invention resides primarily in the sequence of forming operations, the percent reduction taken, and the particular shapes produced by the tools.

Figure 18:
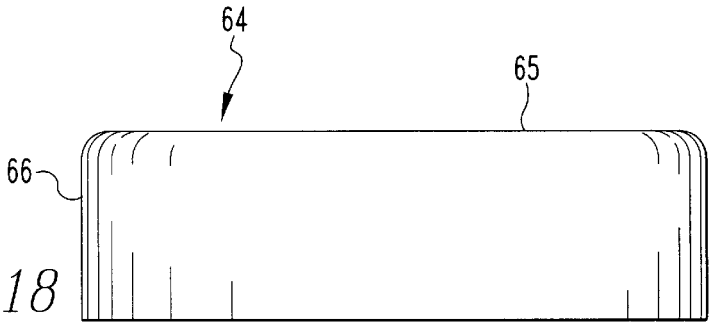
FIGS. 18–27 show a draw and redraw progression for forming sheet metal to form a threaded can body of FIG. 15 in accordance with the present invention and adapted to have a bottom end wall seamed on the can body.

The first step is to form a drawn cup 64 from sheet of thin gauge, hard temper metal. The cup 64 so formed is shown in FIG. 18. The forming operation is preferably a simple blank and draw operation which is well known in the art. The cup 64 includes an end wall 65 and a sidewall 66. The cup 64 is preferably drawn from hard temper aluminum alloy such as 3004-H-19 alloy having a thickness in the range of about 0.007–0.015 inch, and preferably about 0.0125 inch. The sheet metal may or may not be coated with a protective coating. This will depend on whether the cup is to be subsequently ironed to thin its sidewall and whether the coated material can survive such an ironing operation without significant damage to the metal or the coating. For most applications, the metal will not be precoated and will instead be coated after the sidewall of the cup has been ironed.

Figure 19:
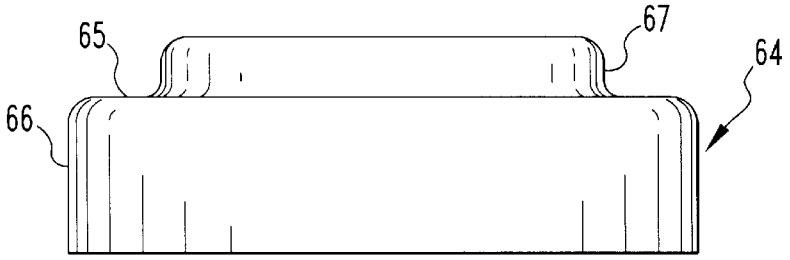
Figure 20:
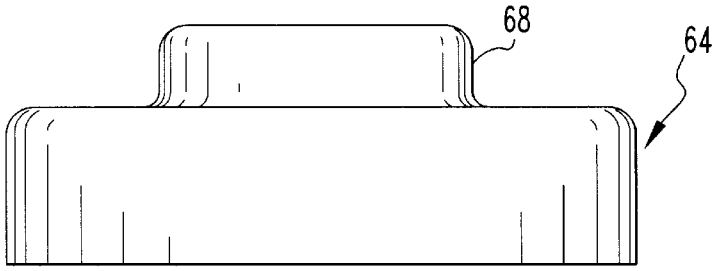
Figure 21:
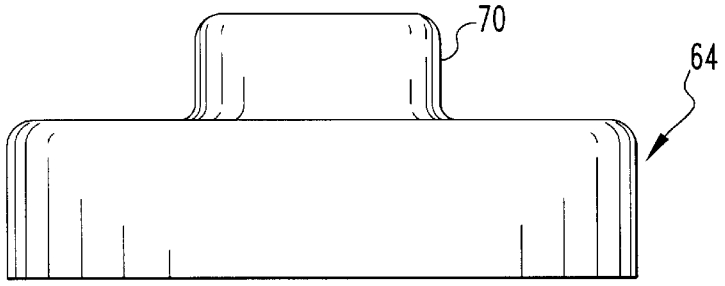
Figure 22:
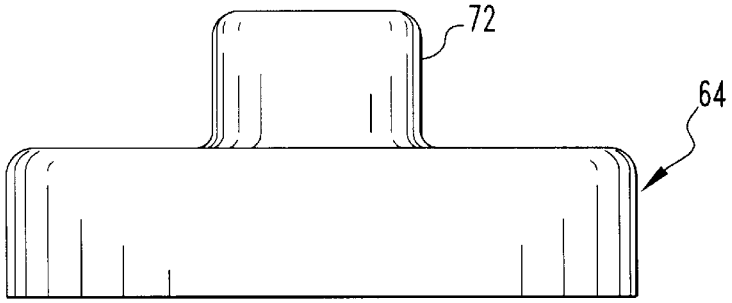
Figure 23:
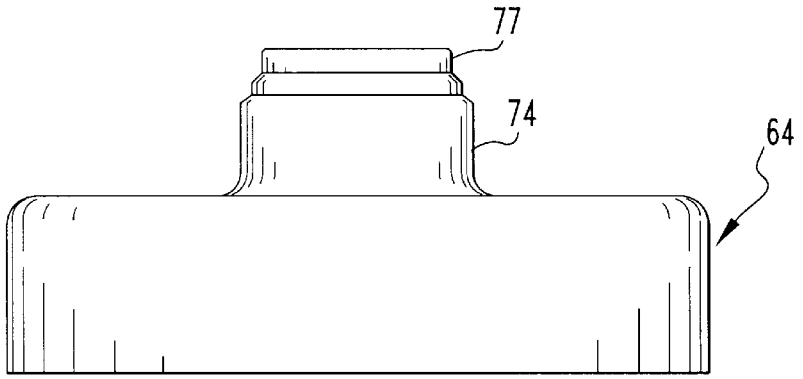
Figure 24:
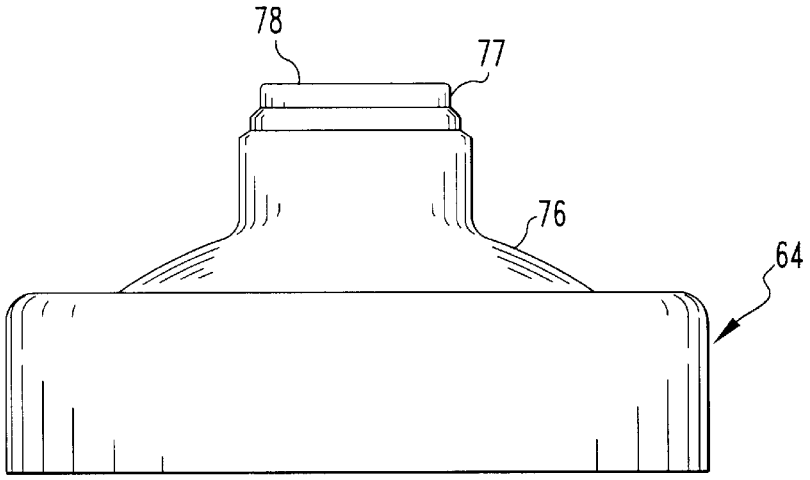

FIG. 19 shows the reformed cup 64 which has a low or shallow boss 67 formed in the center of the end wall 65. In some cases, the boss 67 may be formed in the first blank and draw operation. As with the formation of the cone top of FIGS. 5–11, the boss 67 must be reformed at least two and preferably three or more times to produce progressively higher, smaller diameter bosses 68, 70 and 72 as seen in FIGS. 20–22. The boss 72 must have sufficient length and be an appropriate diameter to provide sufficient metal for threads to be formed therein for receiving a threaded closure. It is important in the practice of this invention that the first draw operation (FIG. 18) not exceed a 45% reduction, and preferably be approximately 35–40% reduction, and that the subsequent redraw operations provide approximately 20–30% reductions. The filth reform shown in FIG. 23 reduces the diameter of the boss and increases its height and also reforms the projecting end 77 of the boss to form at least two steps of reduced diameter at the outwardly projecting end portion of the boss.

Figure 25:
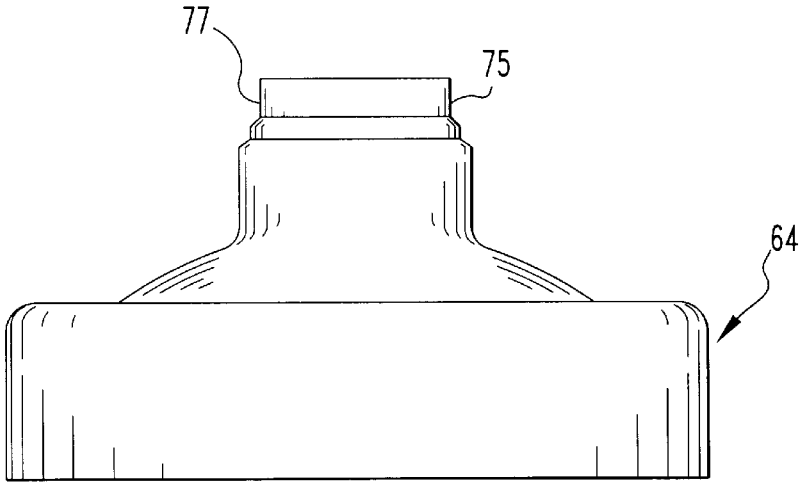
Figure 26:
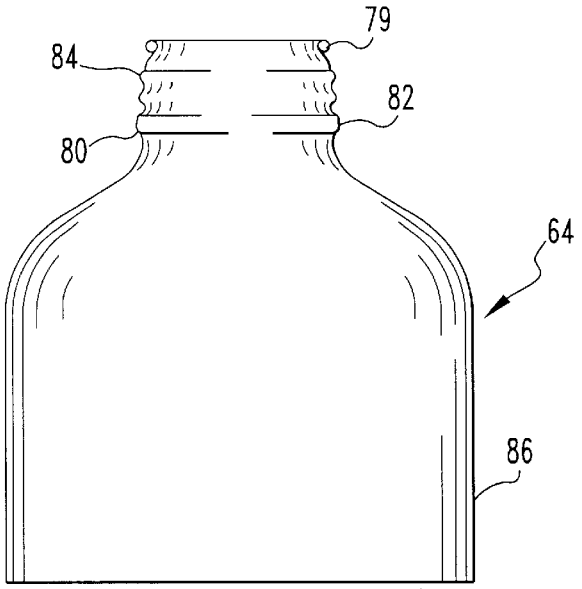
Figure 27:
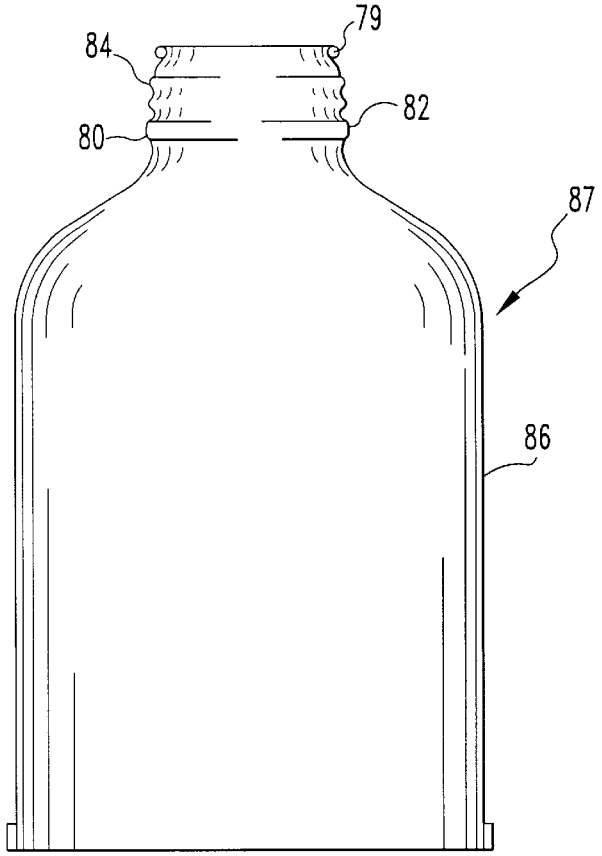

After the boss 74 is reformed to have a reduced diameter end 77, (FIG. 23), the cup is reformed to provide a frustoconical portion 76 as shown in FIG. 74. A major portion of the circular end wall 78 of the boss is then pierced or cut out. The cut edge of the pierced hole may also be wiped upwardly to form an upwardly projecting flange 75 around the opening in the end of the boss as shown in FIG. 25.

The steps of forming a bead on the top edge of the spout and forming threads in the spout are essentially identical to forming the bead and threads in the cone top 10 of FIGS. 1–11. The bead 79 (FIG. 26) may be curled outwardly or inwardly like the beads on the cone tops described above. The spout shown in FIGS. 26 and 27 has an outwardly-projecting annular bead or locking ring 82, a downwardly and outwardly facing shoulder 80 and threads 84 formed in it much like the cone top 10 of FIGS. 1 and 11.

To finish forming the cup 64 into a can 87, the sidewall 86 of the cup 64 is ironed to thin and lengthen it using techniques well known in the art. The sidewall may also receive an additional drawing operation to reduce its diameter and lengthen it before it is ironed. The drawn and ironed can body 87 is preferably post-coated to protect it against the beverage or other product which will be put in the can, and a bottom end, not shown, is put on the can body to form a can ready to be filled. After filling, a pre-threaded plastic or metal closure (FIGS. 3 and 4) is rotatably applied to the threaded spout to seal the contents in the can.

Figure 28:
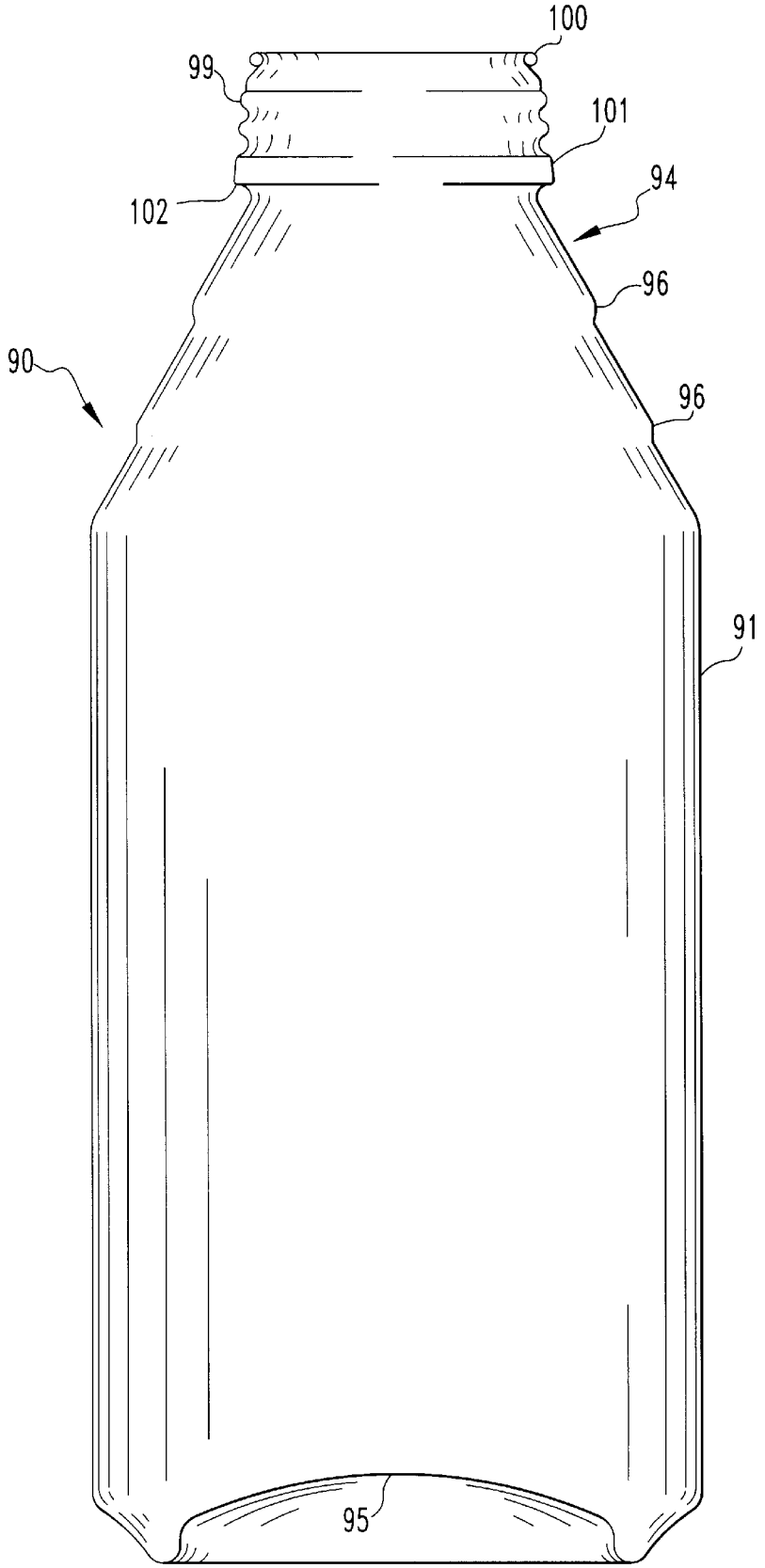
FIG. 28 shows a further alternative for a threaded can of the present invention which has been formed by die necking the open end of a drawn and ironed can body and threads formed in the top of the necked portion.
Figure 29:
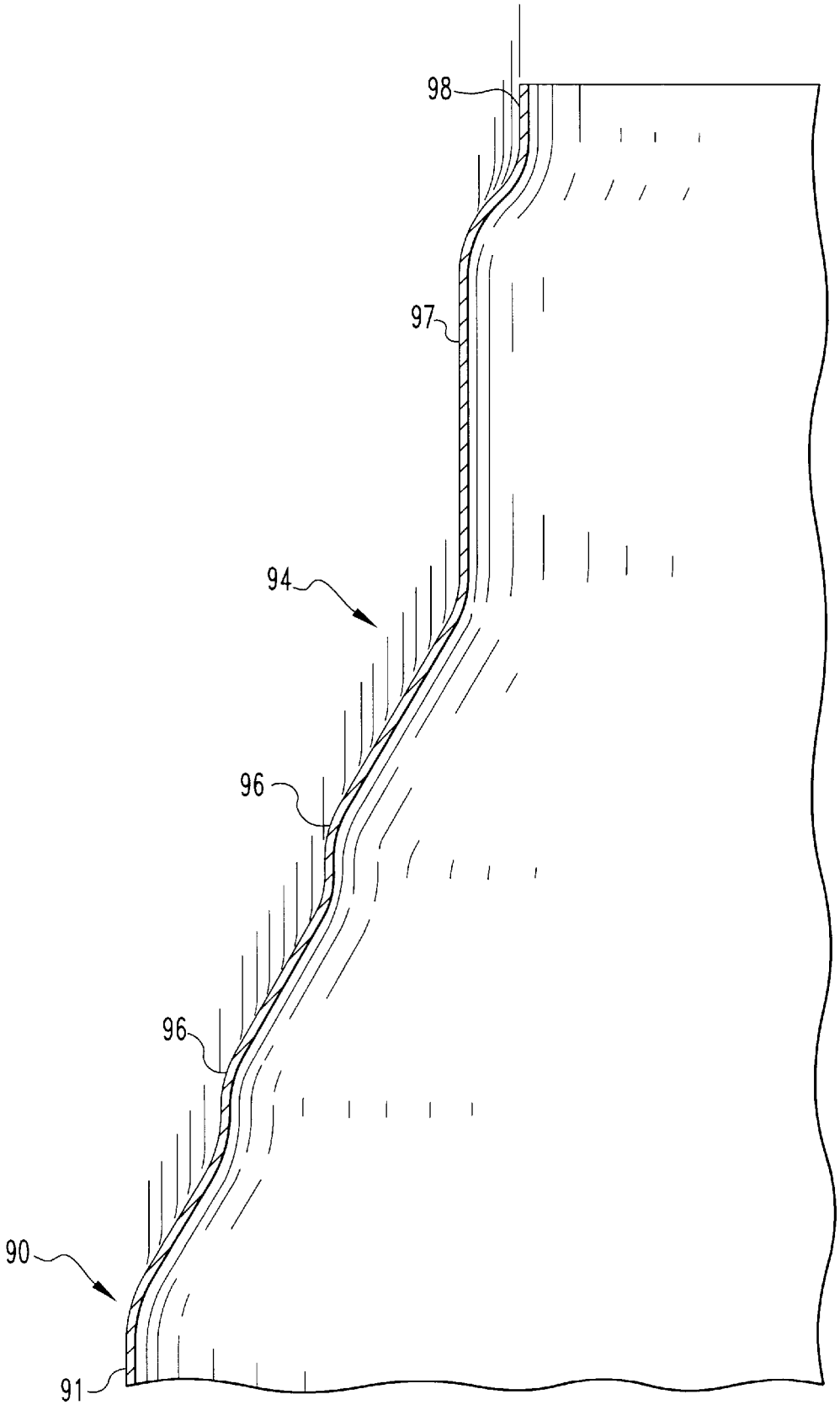
FIG. 29 is an enlargement of the left side neck portion of the can of FIG. 28 showing the progressive reductions in such neck.
Figure 30:
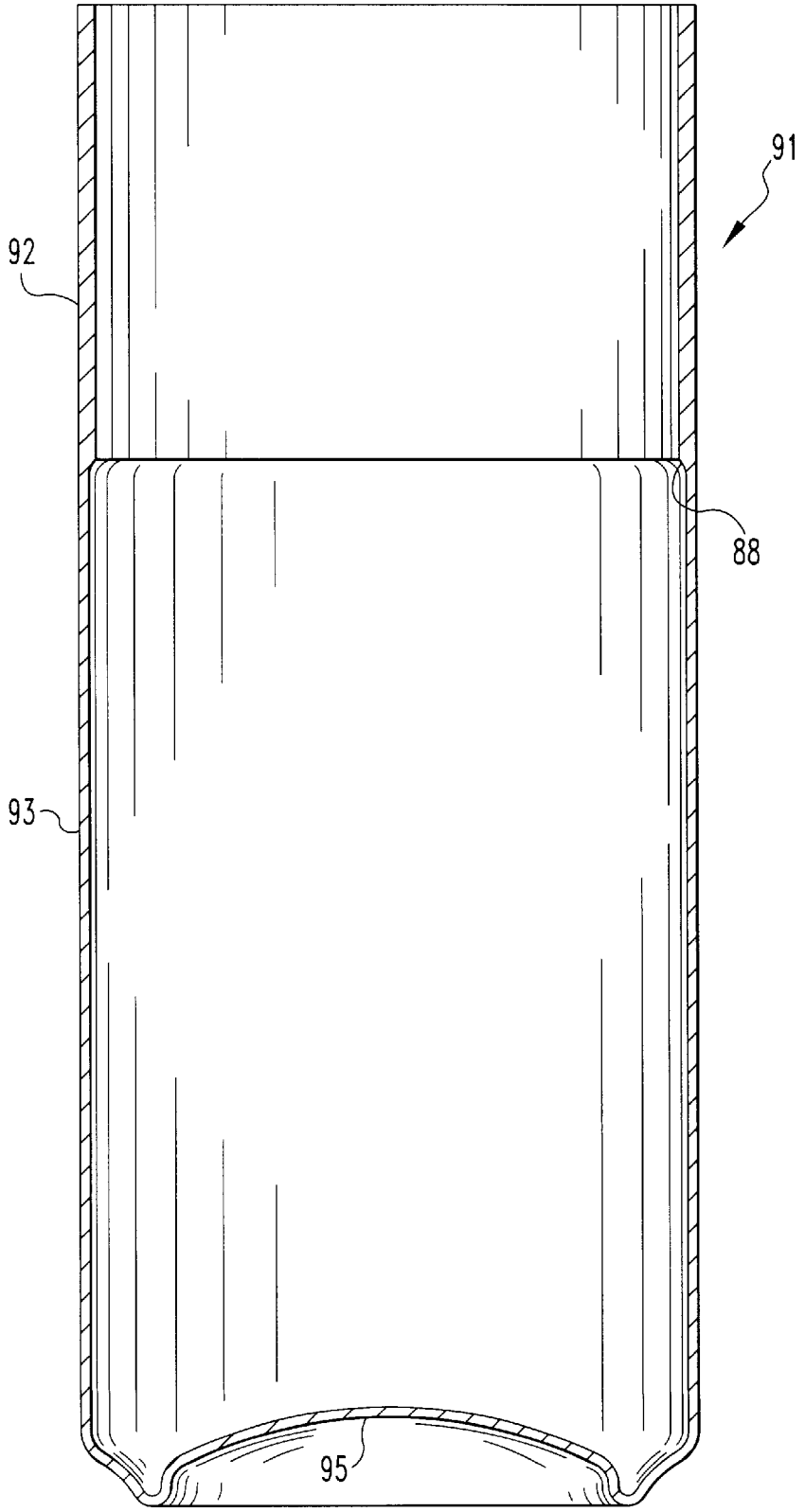
FIG. 30 is a vertical cross-sectional view through a drawn and ironed can body which is adapted to be die necked to form a threaded can body such as the one shown in FIG. 28.

FIGS. 28 and 29 show another embodiment of a threaded aluminum can 90 which has been formed in accordance with this invention. This can 90 is made entirely of one piece of thin hard temper metal such as 3004, 3104 or 3204 H-19 aluminum alloy. The can body before being necked and threaded is a typical drawn and ironed (D&I) can body 91 (FIG. 30) except that it has a top "thick wall" portion 92 adapted to be necked into the necked portion of the can 90. The thick wall portion 92 is not ironed as much as, and is therefore thicker than, the lower portion 93 of the sidewall. The thick wall top portion 92 is more formable into a neck 94 shown in FIGS. 28 and 29 in that the thicker metal can be formed with less wrinkling or other undesirable deformation. The thick wall 92 portion of the can body 91 preferably commences at the point of tangency between the first radius 88 between sidewall and the necked top portion. The thick wall extends to the top of the can body which is the length of the necked portion. A typical drawn and ironed (D&I) can body (FIG. 30) used with this invention may have metal of about 0.0135 inch in the bottom profile 95, a thickness of about 0.0055 inch in the thin wall portion 93, and a thickness about 0.0075 inch in the thick wall portion 92. Such can body may have a diameter of about 3 inches and a height of about 7⅜ inches to hold 20 fluid ounces or a height of about 8½ inches to hold 30 fluid ounces. Other D&I can bodies for use with this invention may have metal thickness of about 0.010 to 0.015 inch in the bottom profile 95, a thickness of about 0.0045 to 0.0065 inch in the thin wall portion 93 and a thickness of about 0.0065 to 0.0085 in the thick wall portion 92. Such cans may have diameters of about 2.5 inches to 3.5 inches and heights of about 5 inches to 10 inches.

In accordance with this invention, drawn or ironed can body 91 is necked inwardly into a frustoconical top portion 94 by a method similar to that illustrated and described in U.S. Pat. No. 5,355,710, issued Oct. 18, 1994, the disclosure of which is incorporated by reference into this application. To form the one-piece aluminum can. 90 requires at least 20, and preferably 25–28 or more necking operations in order to neck an aluminum can body having a diameter of approximately 3 inches down to a neck which is adapted to receive a 38 mm closure. To form a neck on a 3 inch diameter can body to receive a 43 mm closure would require fewer necking operations than are required for the smaller 38 mm closure. The generally frustoconical neck portion 94 preferably has a plurality of concavo-convex steps or ribs 96 in it, rather than have a straight frustoconical neck. The steps 96 in the neck are believed to be aesthetically pleasing and may minimize the appearance of any wrinkles that may form during the multiple necking operations. This effect is produced by processing by a combination of necking as disclosed in U.S. application Ser. No. 07/922,913 which produces a uniform or straight taper and stepped die necking which produces a plurality of circumferential ribs. See U.S. Pat. Nos. 4,519,232; 4,693,018 and 4,732,072.

FIG. 29 is a partial cross-section through the necked top portion 94 of the can 90 prior to forming of the threads and bead on such top portion. As seen in FIG. 29, the top portion 94 includes a cylindrical portion 97 in which threads 99 (FIG. 28) are to be formed and a second cylindrical portion 98 which is adapted to be curled into a bead 100 (FIG. 28) around the top periphery of the can body. The left side of FIG. 29 shows the incremental reduction resulting from each of 27 necking operations used to form the necked portion 94 on a 211 diameter can. It is important that in necking a can body made from hard temper aluminum alloy having a gauge thickness of approximately 0.0135 inch that the first necking reduction be less than approximately 0.090 inch of the can diameter and that each of the subsequent reductions be less than approximately 0.055 inch of the can diameter for a 3 inch diameter (300) can and approximately 0.050 inch for a 2¹¹⁄₁₆ (211) can. In one example of the necking sequence for a 211 diameter can, the first reduction is preferably about 0.087 inch and each of the subsequent reductions is about 0.049–0.051 inch. In the practice of this invention, the metal thickness for larger diameter cans may be thicker than for smaller diameter cans to permit greater reductions in each necking operation.

Necking the top end of a can body in accordance with this invention results in a progressive thickening of the metal in the necked portion and therefore increased structural strength in the necked portion. The first and second cylindrical portions 97 and 98 in which the threads and bead are formed are increased in thickness from an original thickness of approximately 0.0068 inch to a final thickness in a range of approximately 0.009–0.010 inch for 211 diameter cans. For 300 diameter cans, the original thick wall may be about 0.0075 inch and the final thickness may be about 0.011 inch.

FIG. 28 shows the top portion of the can after the bead 100, threads 99, annular bead 101 and shoulder 102 have been formed therein as explained above with reference to the cone top of FIG. 11. Alternatively a threaded metal or plastic sleeve like the ones shown in FIGS. 16 and 17 may be secured on the can body 90 instead of rolling threads in the cylindrical portion 97.

Figure 31:
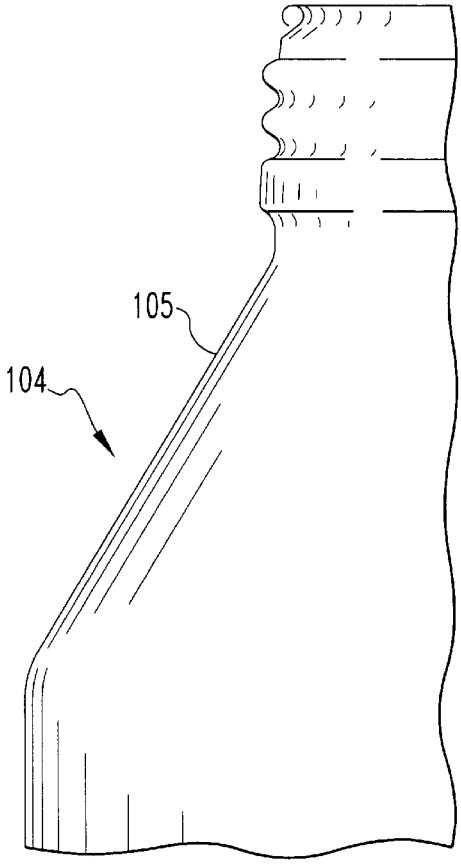
FIG. 31 is a fragmentary cross-sectional view showing the necked portion of a die-necked can similar to the can of FIG. 28 except having a smooth neck instead of a stepped neck portion.
Figure 32:
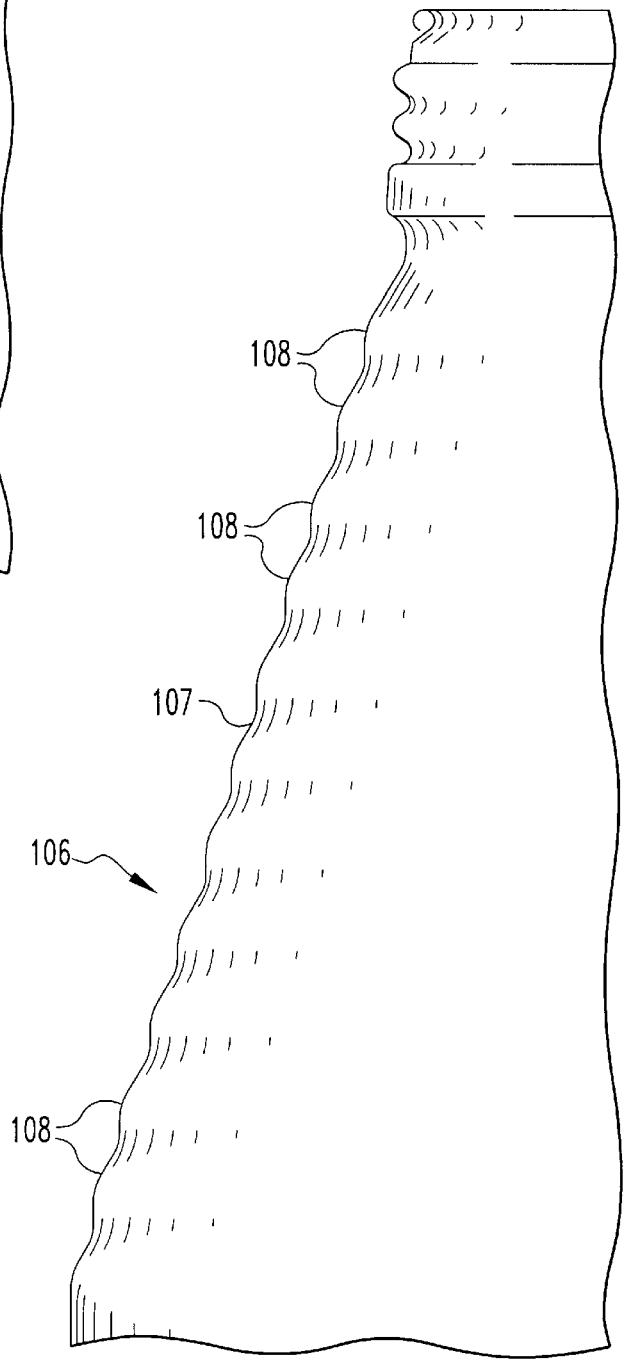
FIG. 32 is a fragmentary cross-sectional view of a can body similar to those of FIGS. 28 and 31 except having approximately 11 separate steps in the neck portion.

FIGS. 31 and 32 are fragmentary enlargements of alternative embodiments of cans 104 and 106 which have tapered neck portions on them which are adapted to receive threaded closures in accordance with this invention. The can 104 of FIG. 31 has a smooth or uniformly tapered neck 105 on it formed generally by a method and tools similar to those disclosed in U.S. patent application Ser. No. 07/922,913, filed Jul. 31, 1992. The can 106 of FIG. 32 has a stepped neck 107 with eleven concavo-convex steps or circumferential beads 108 in it which have been formed by die necking similar to the techniques disclosed, for example, by U.S. Pat. Nos. 4,519,232; 4,693,018 and 4,732,027. It will be apparent to those skilled in the art that more or fewer steps could be provided in the tapered neck of FIG. 32. The number of steps, if any, is a matter of choice depending on the desired shape to be produced, the metal thickness, can diameter, length of neck to be formed and the number of necking operations employed. Producing steps in the tapered neck permits increased reduction in each step as compared to a uniformly tapered neck and therefore reduces the number of operations required to achieve a given amount of taper.

Figure 33:
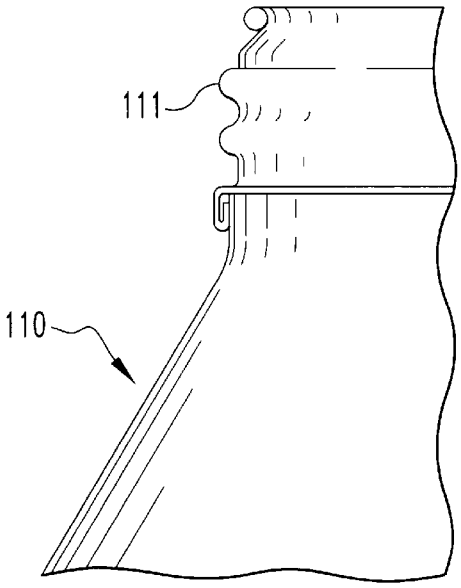
FIGS. 33 and 34 are alternative forms of threaded can bodies in which the threads are in separate sleeves which have been double seamed on the neck portions.
Figure 34:
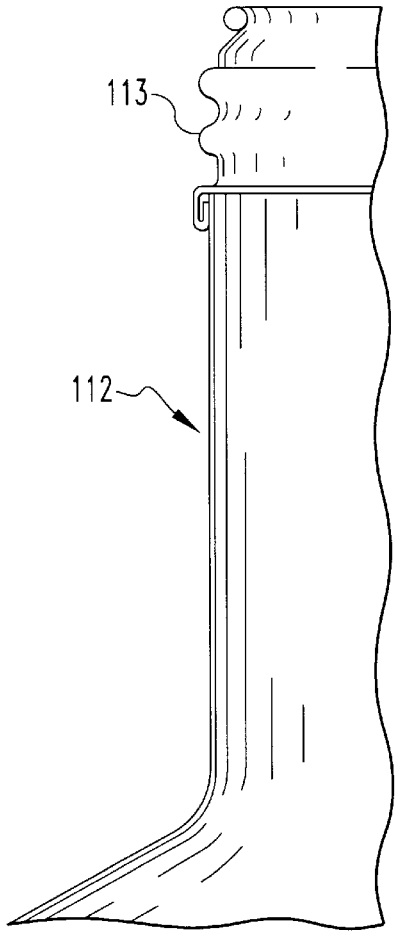

FIG. 33 and 34 are fragmentary cross sections of further embodiments of cans 110 and 112 of this invention in which threaded sleeves 111 and 113 are double seamed on the open ends of the cans. The tapered portion of the cans may be either a cone top similar to the ones shown in FIGS. 1 and 2, a draw/redraw can similar to the one shown in FIG. 15, or a die-necked can similar to ones shown in FIGS. 28, 31 and 32.

Figure 36:
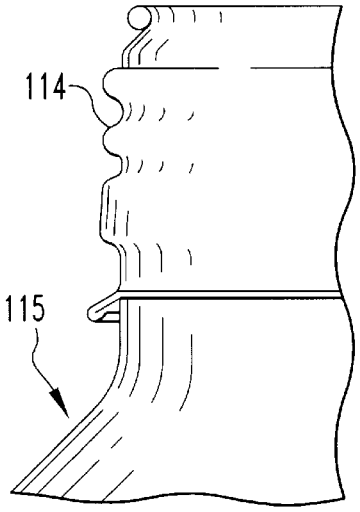
FIGS. 35–37 show the progressive steps that can be employed to double seam a threaded sleeve on a tapered neck portion of a can or cone top to form an assembly similar to those shown in FIGS. 33 and 34.
Figure 35:
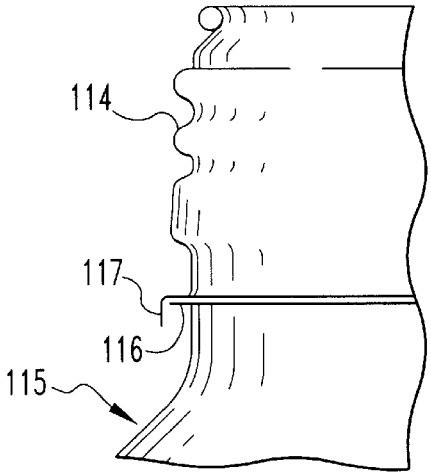
Figure 37:
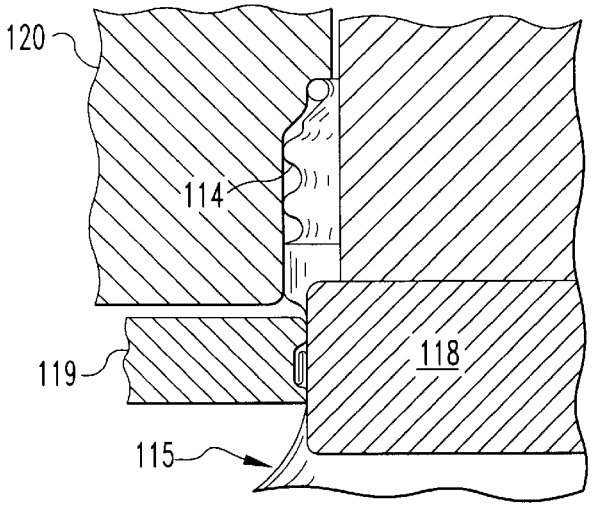

FIGS. 35–39 illustrate a method and tools for seaming a threaded sleeve 114 on a can body 115. An outwardly-projecting flange 116 is provided around the open end of the can body 115 and an L-shaped flange 117 is provided on the bottom of the sleeve 114. The flanges 116 and 117 are interlocked by a two-step seaming operation as shown in FIGS. 36 and 37. The overlapping flanges 116 and 117 are reformed in the first seaming step which partially folds the flanges downwardly. In the second step shown in FIG. 37, an inner support roller 118 is positioned in the can, and a second seamer roller 119 presses the flanges 116, 117 against the inner support roller. A driver chuck 120 holds the sleeve 114 in position during the seaming operation.

Figure 38:
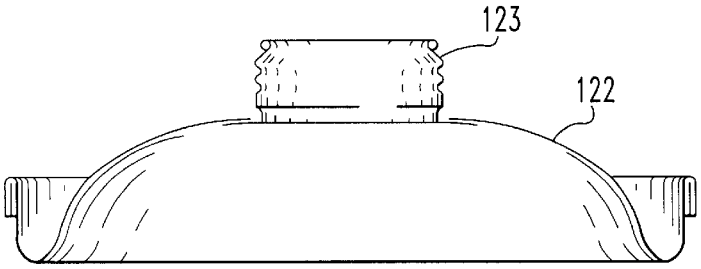
FIG. 38 is a cross-sectional view through an alternative form of a domed top for a threaded can of this invention in which a threaded sleeve is adhesively bonded to the domed top.
Figure 39:
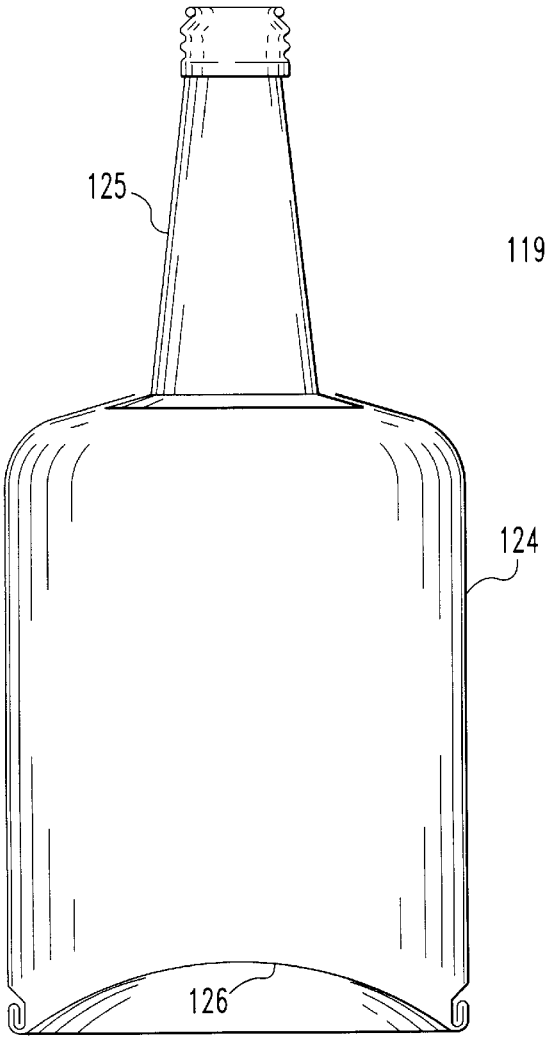
FIG. 39 is a diagrammatic view through another alternative embodiment of this invention in which a long neck with threads on it is adhesively bonded to a can body which has a bottom end wall double seamed on it.

FIGS. 38 and 39 illustrate still further embodiments of a threaded cone top 122 and a threaded can 124 formed in accordance with this invention. The cone top 122 has a threaded sleeve 123 adhesively bonded, welded or otherwise secured in a central opening in the cone top. Can 124 has a long nose threaded spout 125 secured in the center opening in the top of the can. The can 124 has been formed by a draw/redraw method similar to that illustrated in FIGS. 18–25 and has a bottom end wall 126 seamed thereon. The can could also be a die-necked D&I can similar to the cans shown in FIGS. 28, 31 and 32.

It is seen from the above description and the drawings appended hereto that this invention provides several alternatives for forming threaded metal cans for receiving threaded closures. Each of the alternatives offers various advantages. Metal weight of the can is a key issue in selection of the desired alternative. The one piece bottle or can of FIG. 28 offers the lightest weight alternative. For example, 20 ounce capacity one piece aluminum bottles (FIG. 28) will have a net weight of approximately 47–48 pounds per 1000 cans. A can having an integral threaded top of FIG. 15 will have a net weight of approximately 55–56 pounds per 1000 cans of 20 ounce capacity. Two piece cone top cans of FIG. 1 have a net weight of approximately 57–58 pounds per 1000 cans (20 ounces capacity), and the bonded cone top can of FIG. 2 has a net weight of approximately 53–54 pounds per 1000 cans (20 ounces). Cans having separate threaded sleeves weigh about 7 pounds per thousand more than the integrally threaded cans.

Cans of this invention provide a combination of advantages and features not available in any single package present in the prior art. Cans of this invention provide a lightweight, low cost, economically recyclable, resealable/reclosable, non-shattering, crushable package which is suitable for hot filling, cold filling, aseptic filling, pasteurization, and retorting and for holding internal pressures of 40–110 psi with long shelf life due to the barrier properties of the metal. Cans of this invention include a threaded neck portion which is adapted to receive a threaded closure and meet the performance requirements for retaining the closure on the threads and for providing sealing fidelity between the can and the closure. The cans are especially adapted to have threads provided thereon which are dimensionally precise to meet such performance requirements. There has been a long-standing need for packages which will provide the many advantages offered by cans of this invention.

While several examples of embodiment and methods of the present invention have been illustrated and described, it will be appreciated that the invention may be otherwise variously embodied and practiced within the scope of the following claims. For example, this invention includes forming a necked container with inclined lugs formed therein or in a sleeve attached thereto for securing a lug cap, instead of a threaded closure, on the can top.

What is claimed is:

1. A lightweight reclosable metal can made from thin gauge, hard temper aluminum alloy having a thickness of about 0.007–0.015 inch comprising a can body having a drawn and ironed sidewall and a bottom end wall, and having a cone top secured on said sidewall, said cone top including a cylindrical pouring spout with an outwardly curled bead around its top and threads on said cylindrical pouring spout below said curled bead, said curled bead having a lesser radial extent than said threads such that a threaded closure can be screwed onto said cone top to seal contents in the can.

2. A can as set forth in claim 1 in which said cone top has a cylindrical pouring spout and a threaded sleeve secured on said pouring spout.

3. A can as set forth in claim 1 in which said cone top is seamed on said drawn and ironed can body.

4. A can as set forth in claim 1 in which said sidewall and said bottom end wall are integral with each other.

* * * * *